US008162691B2

(12) United States Patent
Chang

(10) Patent No.: US 8,162,691 B2
(45) Date of Patent: Apr. 24, 2012

(54) MODULAR ELECTRICAL CONNECTOR

(76) Inventor: Nai-Chien Chang, Sanchong (TW)

( * ) Notice: Subject to any disclaimer, the term of this patent is extended or adjusted under 35 U.S.C. 154(b) by 160 days.

(21) Appl. No.: 12/770,231

(22) Filed: Apr. 29, 2010

(65) Prior Publication Data

US 2011/0028030 A1 Feb. 3, 2011

(30) Foreign Application Priority Data

Jul. 29, 2009 (TW) ..... 98213924 U

(51) Int. Cl.
*H01R 25/00* (2006.01)

(52) U.S. Cl. ..... 439/541.5; 439/638; 439/655

(58) Field of Classification Search ..... 439/541.5, 439/638, 79, 80, 655
See application file for complete search history.

(56) References Cited

U.S. PATENT DOCUMENTS

| | | | | |
|---|---|---|---|---|
| 4,523,296 | A * | 6/1985 | Healy, Jr. | 439/651 |
| 4,758,175 | A * | 7/1988 | Didier et al. | 439/281 |
| 5,006,080 | A * | 4/1991 | Ichitsubo et al. | 439/634 |
| 5,045,977 | A * | 9/1991 | Cesar | 361/816 |
| 5,064,389 | A * | 11/1991 | Klein et al. | 439/651 |
| 5,501,608 | A * | 3/1996 | Scheer et al. | 439/218 |
| 5,575,690 | A * | 11/1996 | Eaton | 439/717 |
| 5,727,972 | A * | 3/1998 | Aldous et al. | 439/655 |
| 6,387,131 | B1 * | 5/2002 | Miehlke et al. | 623/20.15 |
| 6,887,108 | B2 * | 5/2005 | Wu | 439/638 |
| 7,004,765 | B2 * | 2/2006 | Hsu et al. | 439/79 |
| 7,090,538 | B1 * | 8/2006 | Huang | 439/638 |
| 7,094,109 | B2 * | 8/2006 | Chou | 439/651 |
| 7,288,006 | B2 * | 10/2007 | Su et al. | 439/638 |
| 7,411,783 | B2 * | 8/2008 | Su | 361/679.55 |
| 7,632,139 | B2 * | 12/2009 | Chou et al. | 439/541.5 |
| 7,833,051 | B2 * | 11/2010 | Huang et al. | 439/541.5 |
| 7,874,874 | B2 * | 1/2011 | Chang | 439/620.01 |
| 7,922,538 | B2 * | 4/2011 | Chang | 439/620.16 |
| 7,942,702 | B2 * | 5/2011 | Chang | 439/638 |
| 8,025,534 | B2 * | 9/2011 | Bates et al. | 439/638 |
| 8,038,474 | B2 * | 10/2011 | Ju | 439/607.01 |
| 2007/0232132 | A1 * | 10/2007 | Ling et al. | 439/541.5 |
| 2008/0055842 | A1 * | 3/2008 | Chang et al. | 361/686 |
| 2009/0253309 | A1 * | 10/2009 | Didier | 439/686 |
| 2010/0267282 | A1 * | 10/2010 | Tsai | 439/607.17 |
| 2011/0028030 | A1 * | 2/2011 | Chang | 439/492 |

* cited by examiner

*Primary Examiner* — Neil Abrams
(74) *Attorney, Agent, or Firm* — Chun-Ming Shih; HDLS IPR Services

(57) ABSTRACT

A modular electrical connector includes a base and at least one adaptor. The base is provided with at least one first assembling port and an insertion port. An insertion slot is provided between the first assembling port and the insertion port. The insertion slot has a plurality of insertion holes. Each of the plurality of insertion holes is provided with an electrical-conductive pin extending into the insertion port. The adaptor has a rear end with an insertion pin and a front end with a connecting port. The connecting port has a tongue therein. The tongue is provided with a plurality of electrical-conductive terminals. One end of each of the electrical-conductive terminals is electrically connected with the insertion pin. The adaptor is assembled in the first assembling port. The insertion pin is inserted into and electrically connected to the insertion slot. The electrical connection between the plug and the electrical-conductive pin is achieved once a plug of a flat cable is inserted into the insertion port of the base.

3 Claims, 12 Drawing Sheets

MODULAR ELECTRICAL CONNECTOR

BACKGROUND OF THE INVENTION

1. Field of the Invention

The present invention relates to an electrical connector, and in particular to an electrical connector which can be assembled quickly with different transmission interfaces based on the demands of clients.

2. Description of Prior Art

With the continuous advancement of science and technology and the demands for practice use, various kinds of new-generation connectors are developed, such as a stack-up connector or a multi-port connector with the combination of USB and HDMI, USB and DisplayPort, or USB and e-SATA. With this arrangement, the layout of different I/O transmission interfaces can be simplified with less space.

Although the stack-up connector or multi-port connector really simplifies the layout of different I/O transmission interfaces, such a connector is unchangeable in terms of specification after it is manufactured. If a client needs another kind of stack-up connector or multi-port connector, such as the connector having the combination of USB, HDMI and DisplayPort or the combination of HDMI and DisplayPort, the manufacturer has to design another mold for this demand. After this new connector is manufactured, however, if the number of users or sales volume is not large enough, the production cost of the connector will be shared by the insufficient users, so that the price is inevitably higher for the users.

SUMMARY OF THE INVENTION

In order to solve the problems in prior art, the present invention is to provide a modular electrical connector, whereby the manufacturer can quickly assemble different standards of transmission interfaces in one connector based on the demands of clients.

The present invention provides a modular electrical connector, including:

a base provided with at least one first assembling port and an insertion port, an insertion slot being provided between the first assembling port and the insertion port, the insertion slot having a plurality of insertion holes, each of the plurality of insertion holes being provided with an electrical-conductive pin extending into the insertion port; and at least one adaptor, the adaptor having a rear end with an insertion pin and a front end with a connecting port, the connecting port having a tongue therein, the tongue being provided with a plurality of electrical-conductive terminals, one end of each of the electrical-conductive terminals being electrically connected with the insertion pin, the adaptor being assembled in the first assembling port, the insertion pin being inserted into and electrically connected to the electrical-conductive pin;

wherein the electrical connection between the plug and the electrical-conductive pin is achieved once a plug of a flat cable is inserted into the insertion port of the base.

DETAILED DESCRIPTION OF THE INVENTION

The detailed description and technical contents of the present invention will be explained with reference to the accompanying drawings. However, it should be understood that the drawings are illustrative only, but not used to limit the present invention.

Figure 1:
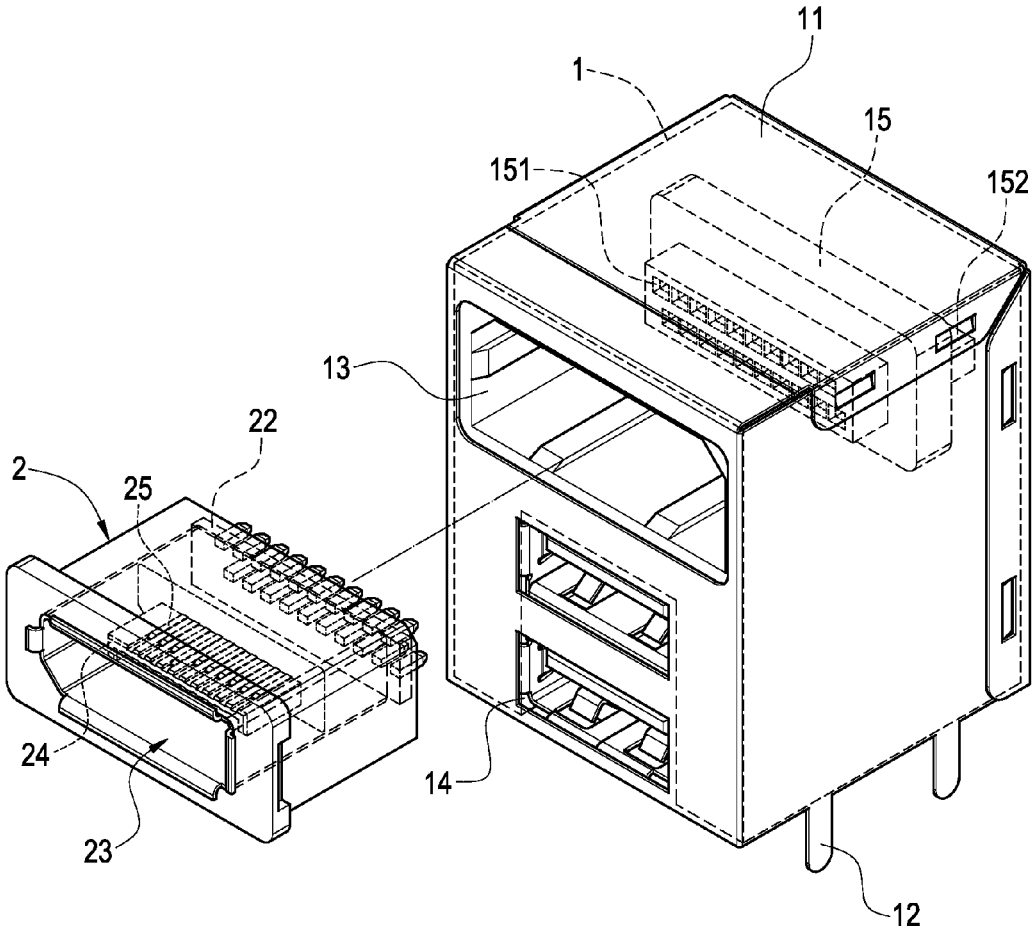
FIG. 1 is an exploded perspective view showing an electrical connector of the present invention.
Figure 2:
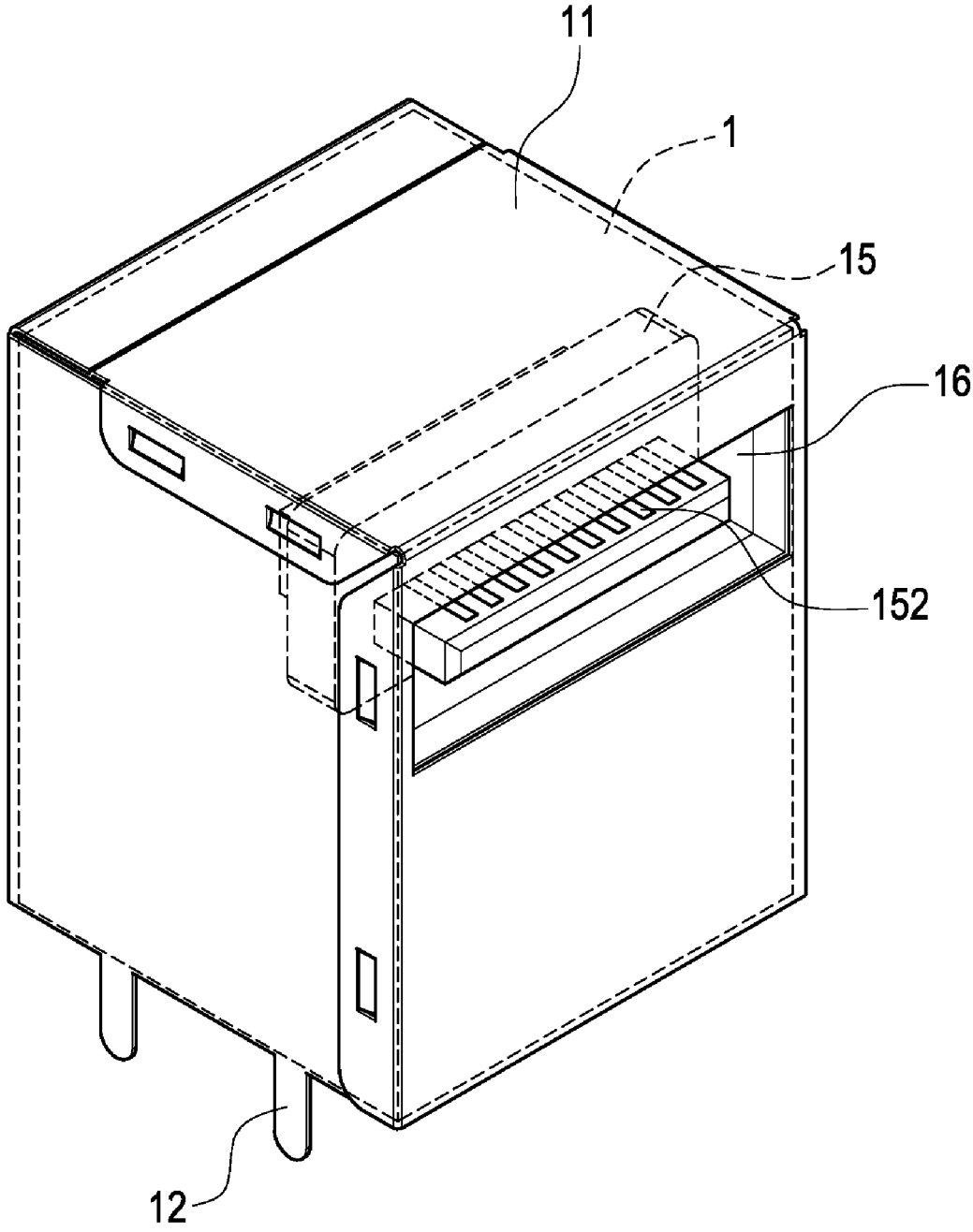
FIG. 2 is a rear perspective view showing the electrical connector of the present invention.

Please refer to FIGS. 1 and 2, which are an exploded perspective view and a rear view showing the electrical connector of the present invention respectively. The electrical connector of the present invention includes a base 1 and an adaptor 2.

The upper surface of the base 1 is covered by a metallic casing 11. The underside of the metallic casing 11 extends to form a fixing leg 12. The base 1 is provided with a first assembling port 13 and two second assembling ports 14. The interior of the first assembling port 13 has an insertion slot 15. The front end of the insertion slot 15 has a plurality of insertion holes 151, and its rear end has a plurality of electrical-conductive pins 152 that extend outwardly from the insertion holes 151 respectively. The electrical-conductive pins 152 are located into an insertion port 16 provided on a rear surface of the base 1. The insertion port 16 allows a plug of a cable (not shown) to be inserted into and electrically connected to the electrical-conductive pins 152. Further, like the first assembling port 13, the second assembling port 14 can be assembled with a connector having the standard of any one of HDMI, DisplayPort, USB, and e-SATA.

The adaptor 2 is assembled in the first assembling port 13. The front end of the adaptor 2 has a baffle 21 and its rear end has an insertion pin 22. The adaptor 2 has a connecting port 23. The interior of the connecting port 23 has a tongue 24. The tongue 24 is provided with a plurality of electrical-conductive terminals 25. One end of each of the electrical-conductive terminals 25 is electrically connected to the insertion pin 22. When the adaptor 2 is inserted into the first assembling port 13, the insertion pin 22 is inserted into the insertion hole 151 of the insertion slot 15, so that the insertion pin 22 can be electrically connected to the insertion slot 15. In the drawings, the connecting port 23 of the adaptor 2 is configured to have the standard of any one of HDMI, DisplayPort, USB, and e-SATA, so that a transmission line or device having a HDMI, DisplayPort or USB type transmission interface can be inserted into the connecting port 23.

Figure 3:
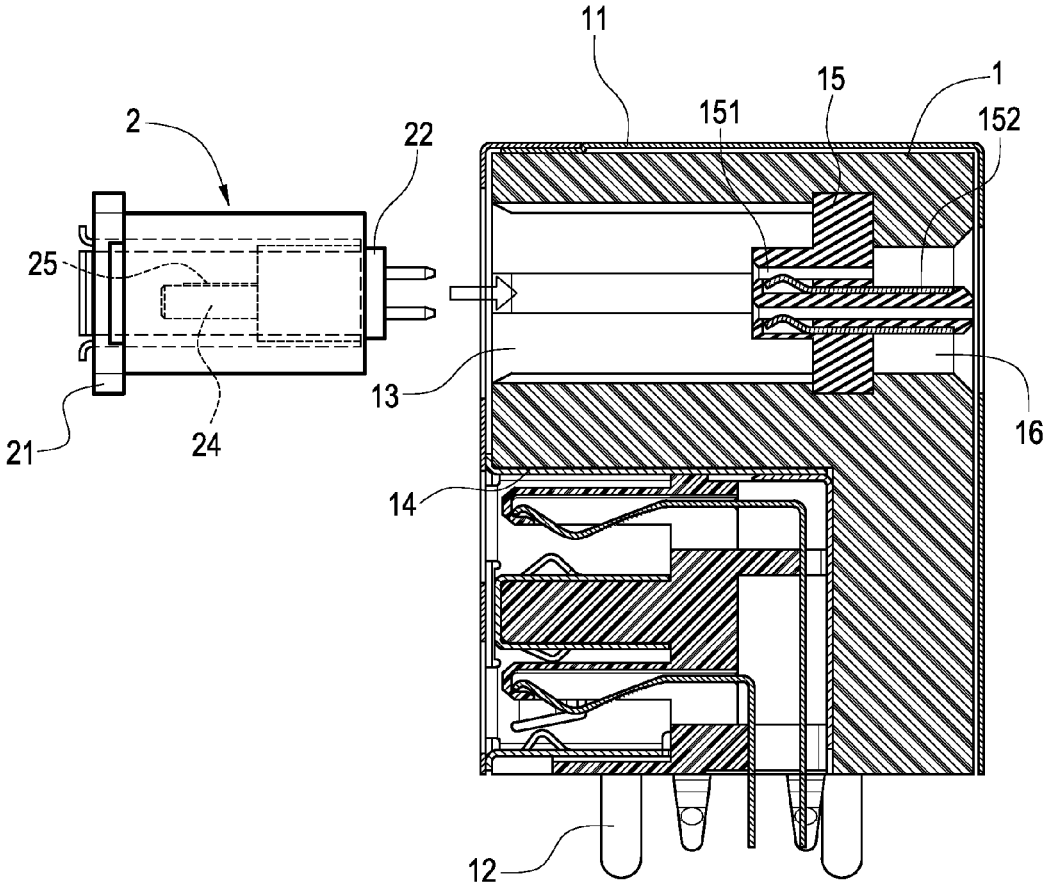
FIG. 3 is a side cross-sectional view showing the assembly of the electrical connector of the present invention.
Figure 4:
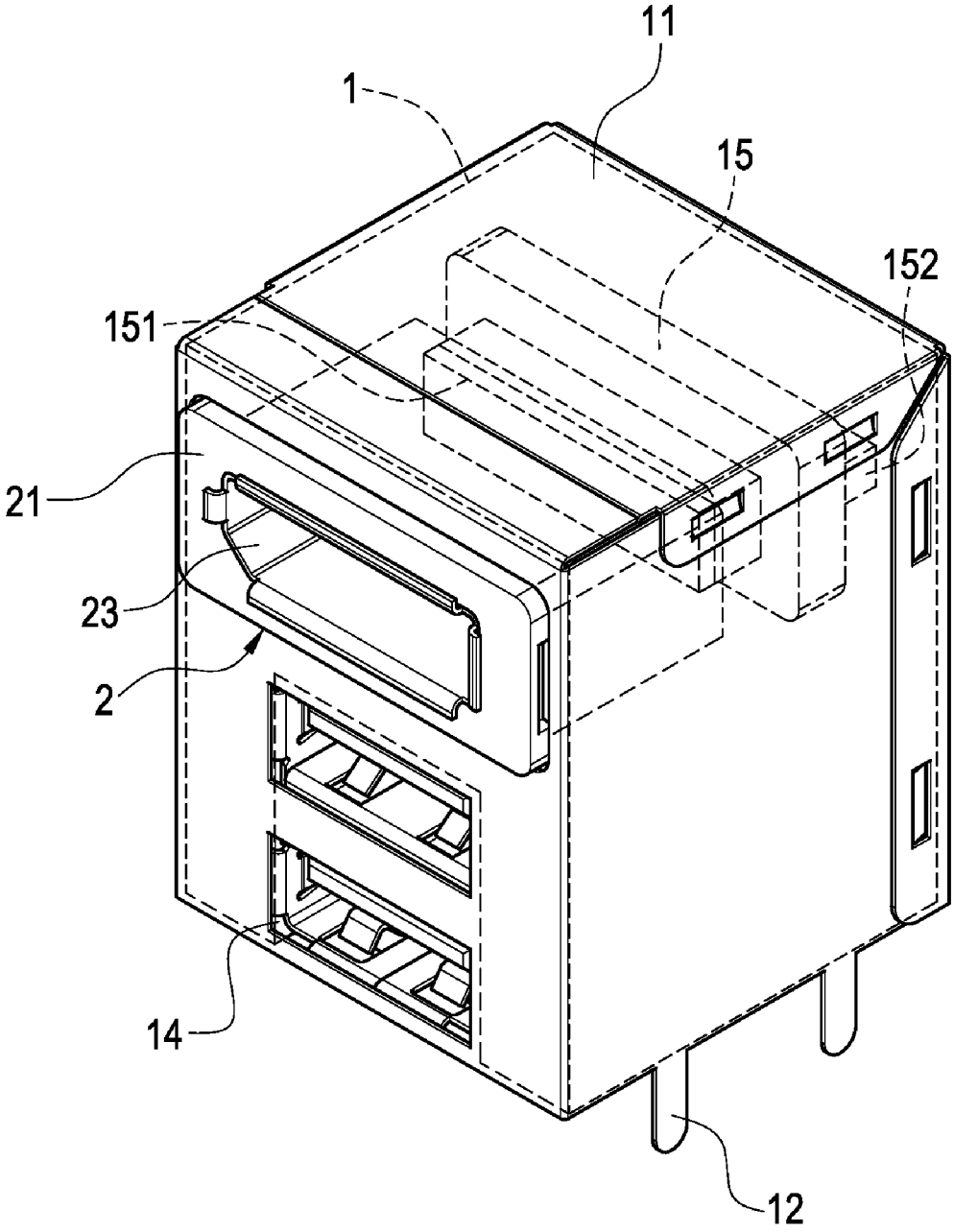
FIG. 4 is a perspective view showing the external appearance of the electrical connector of the present invention after assembly.
Figure 5:
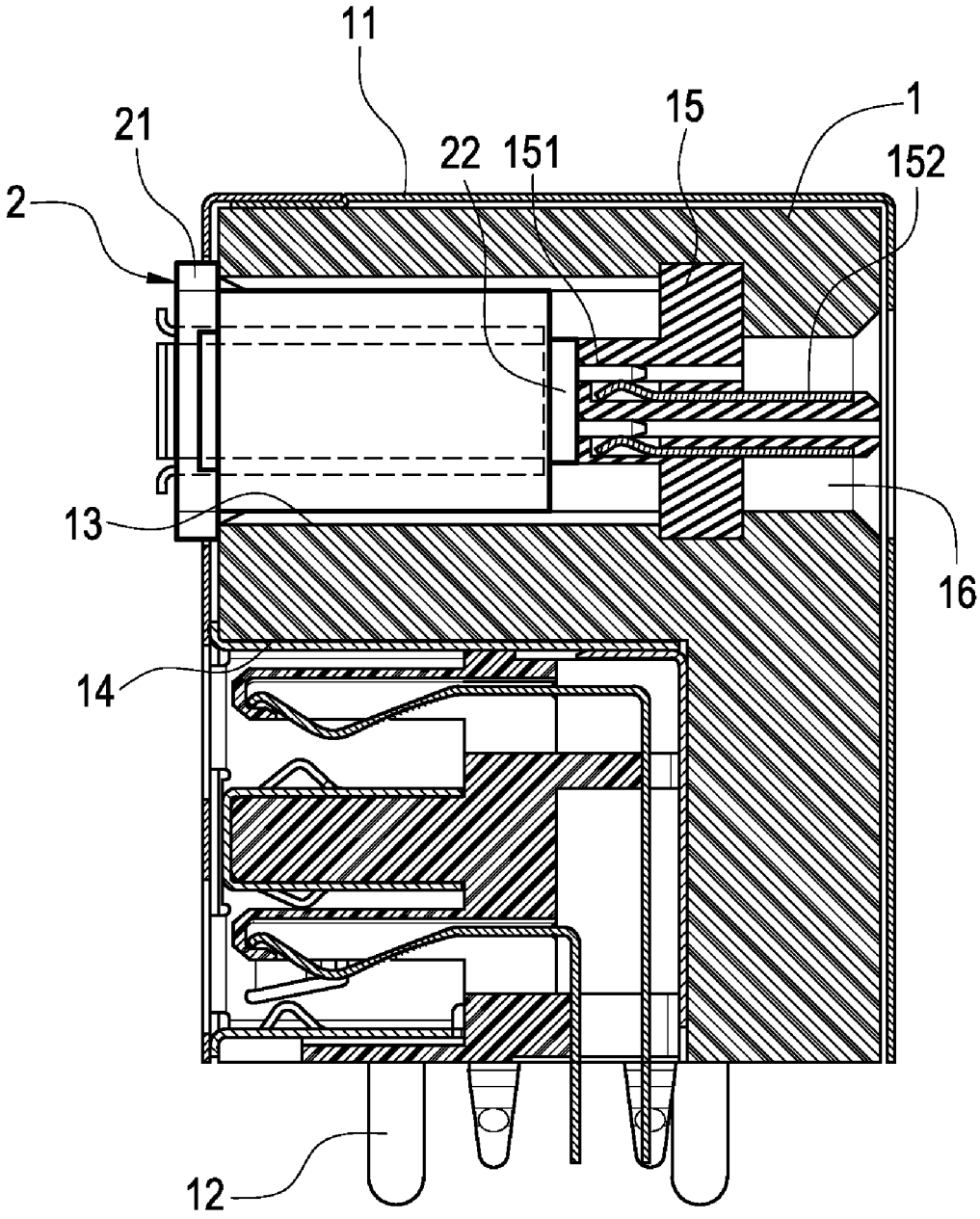
FIG. 5 is a side cross-sectional view showing the electrical connector of the present invention after assembly.

Please refer to FIGS. 3 to 5. FIG. 3 is a side cross-sectional view showing the assembly of the electrical connector of the present invention. FIG. 4 is a perspective view showing the external appearance of the electrical connector of the present invention after assembly. FIG. 5 is a side cross-sectional view showing the electrical connector of the present invention after assembly. The electrical connector of the present invention can be customized based on the demands of clients. If the client requires a stack-up connector having the combination of DisplayPort and USB, the manufacturer can assemble the adaptor 2 having the standard of DisplayPort into the first assembling port 13 and pushed the adaptor 12 further therein. In this way, the insertion pin 22 is inserted into the insertion hole 151 of the insertion slot 15, thereby achieving the electrical connection between the adaptor 2 and the base 1.

After the DisplayPort type adaptor 2 is assembled into the base 1, not only a transmission line or device having a USB type transmission interface can be inserted into the base 1, but also a transmission line having the standard of DisplayPort can be inserted into the adaptor 2.

Figure 6:
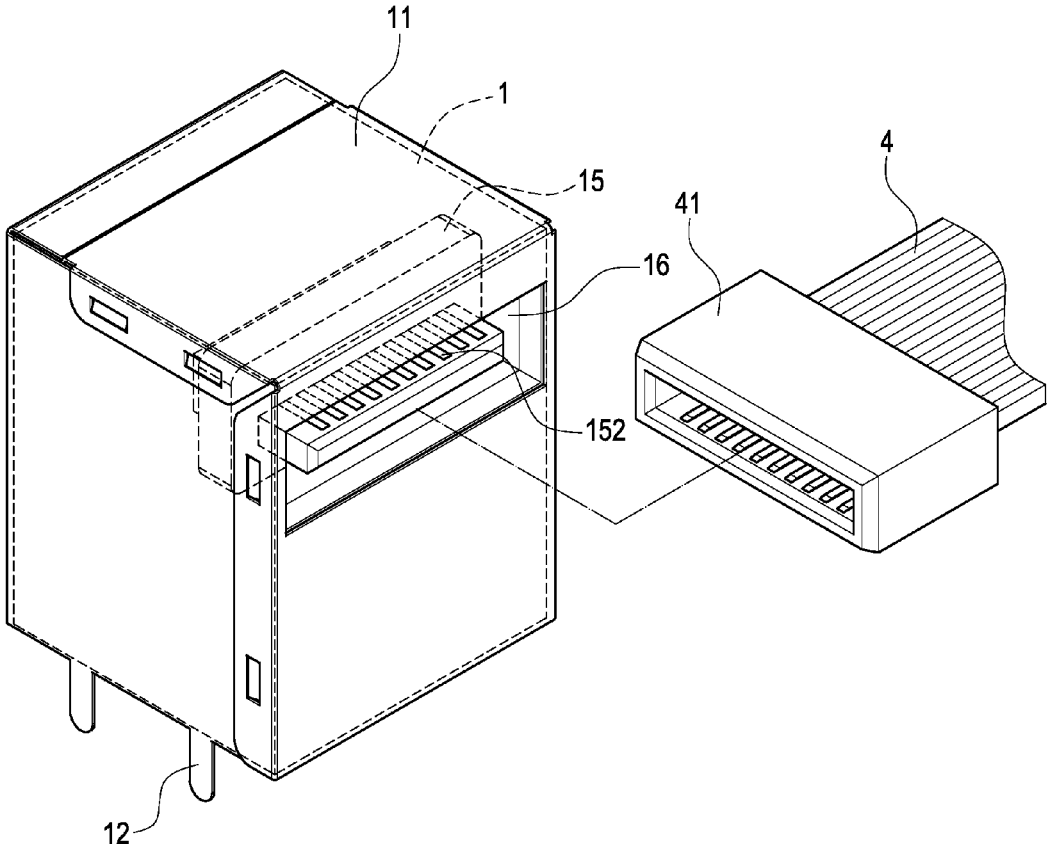
FIG. 6 is a schematic view showing the insertion of a cable into the electrical connector of the present invention.
Figure 7:
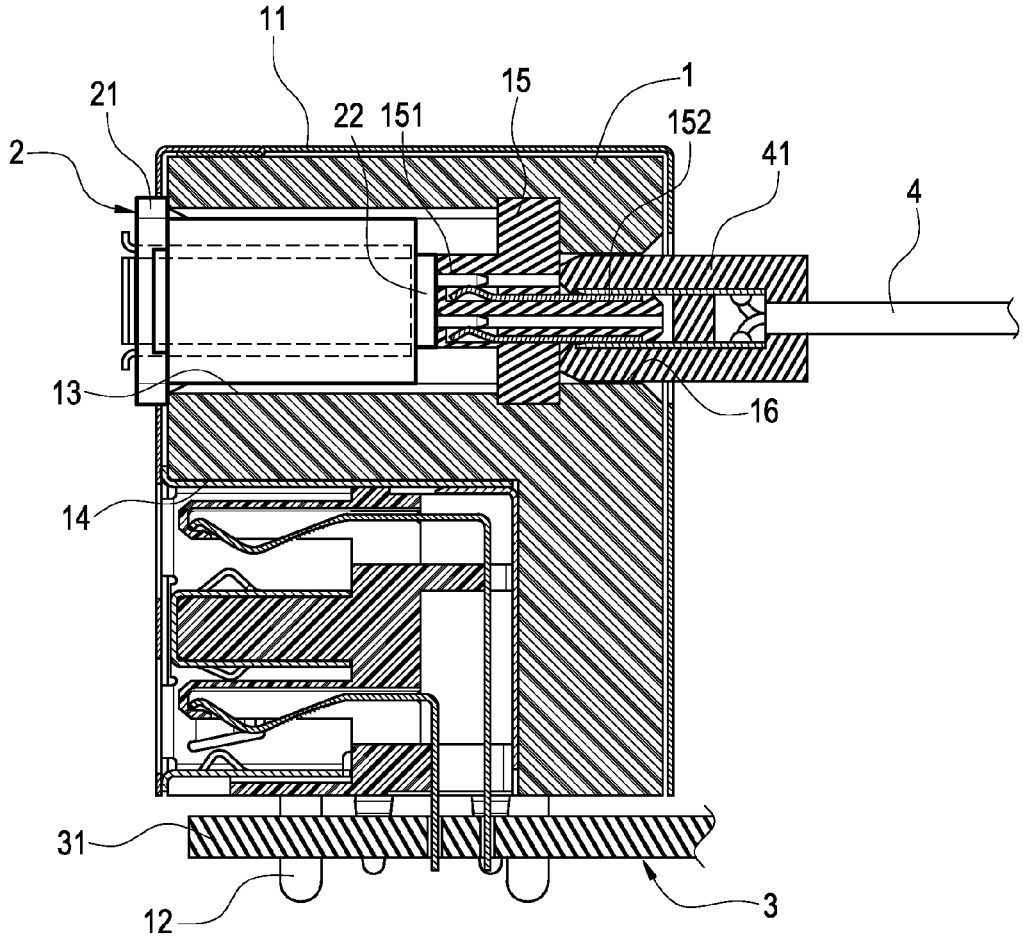
FIG. 7 is a schematic view showing the electrical connection between the electrical connector of the present invention and an electronic device.

Please refer to FIGS. 6 and 7. FIG. 6 is a schematic view showing the insertion of a cable into the electrical connector of the present invention, and FIG. 7 is a schematic view showing the electrical connection between the electrical connector of the present invention and an electronic device. As shown in these figures, after the DisplayPort type adaptor 2 is assembled into the base 1, the fixing leg 12 under the metallic casing 11 of the base 1 is electrically connected to the mother board 31 of an electronic device 3. Then, a plug 41 of a flat cable 4 is inserted into the insertion port 16 of the base 1 with the plug 41 being electrically connected to the electrical-conductive pins 152, whereby the adaptor 2 allows a DisplayPort type transmission line to be inserted therein for signal transmission.

Figure 8:
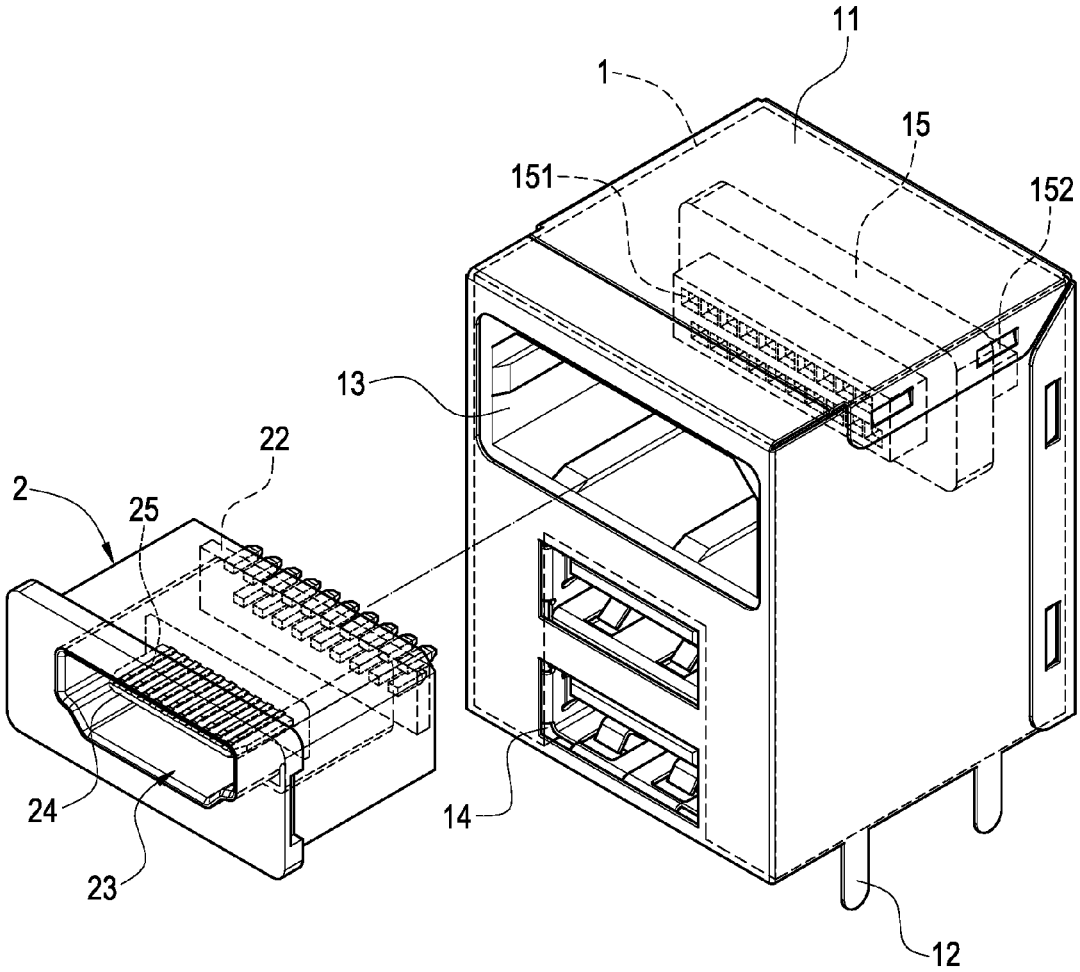
FIG. 8 is a schematic view showing a second embodiment of the present invention.

Please refer to FIG. 8, which shows the second embodiment of the present invention. As shown in this figure, when the connecting port 23 of the adaptor 2 has the standard of HDMI and is assembled into the base 1, such a HDMI type adaptor 2 allows a HDMI type transmission line to be inserted therein for signal transmission.

Figure 9:
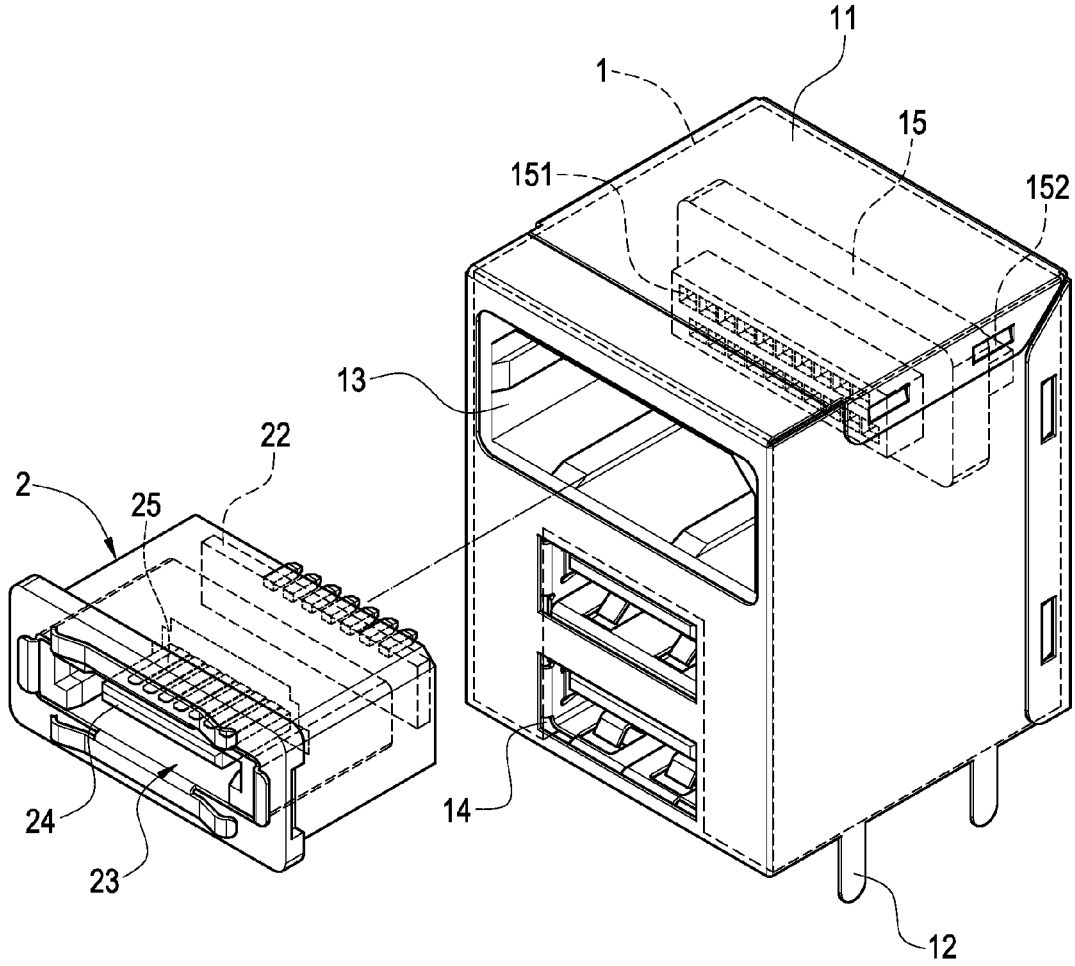
FIG. 9 is a schematic view showing a third embodiment of the present invention.

Please refer to FIG. 9, which shows the third embodiment of the present invention. As shown in this figure, when the connecting port 23 of the adaptor 2 has the standard of e-SATA and is assembled into the base 1, such an e-SATA type adaptor 2 allows an e-SATA type transmission line to be inserted therein for signal transmission.

Figure 10:
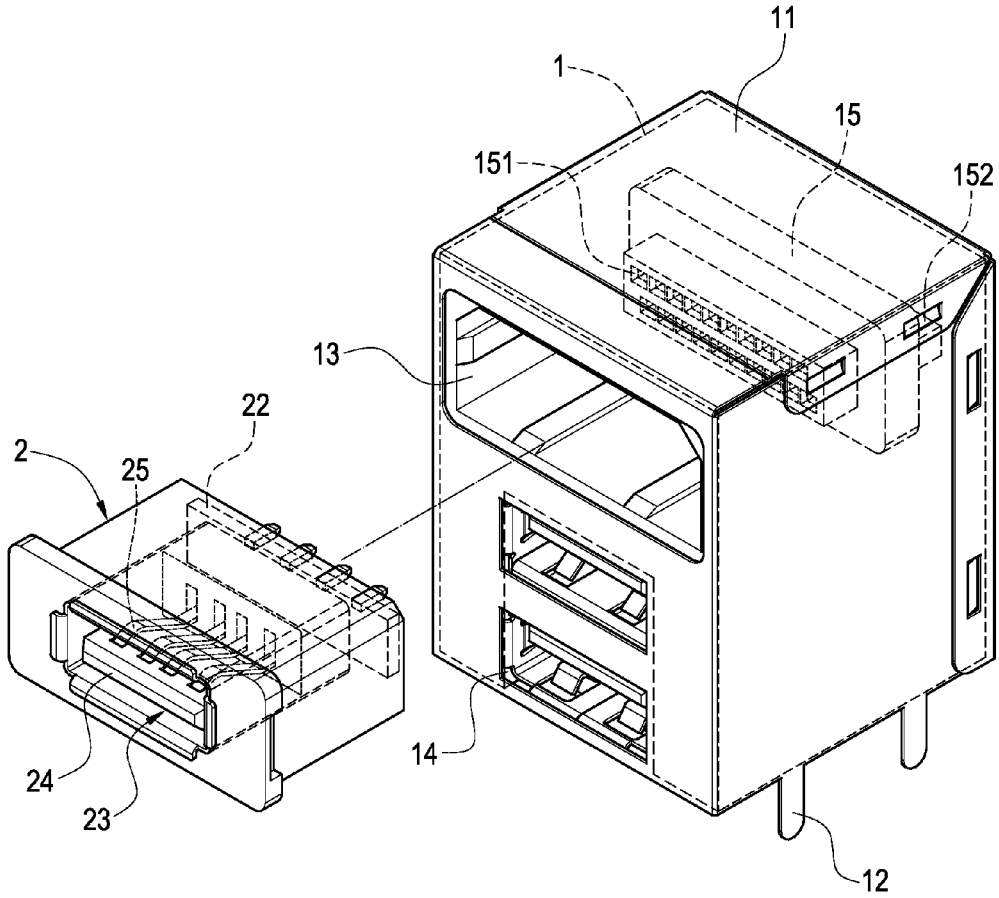
FIG. 10 is a schematic view showing a fourth embodiment of the present invention.

Please refer to FIG. 10, which shows the fourth embodiment of the present invention. As shown in this figure, when the connecting port 23 of the adaptor 2 has the standard of USB and is assembled into the base 1, such a USB type adaptor 2 allows a USB type transmission line to be inserted therein for signal transmission.

Figure 11:
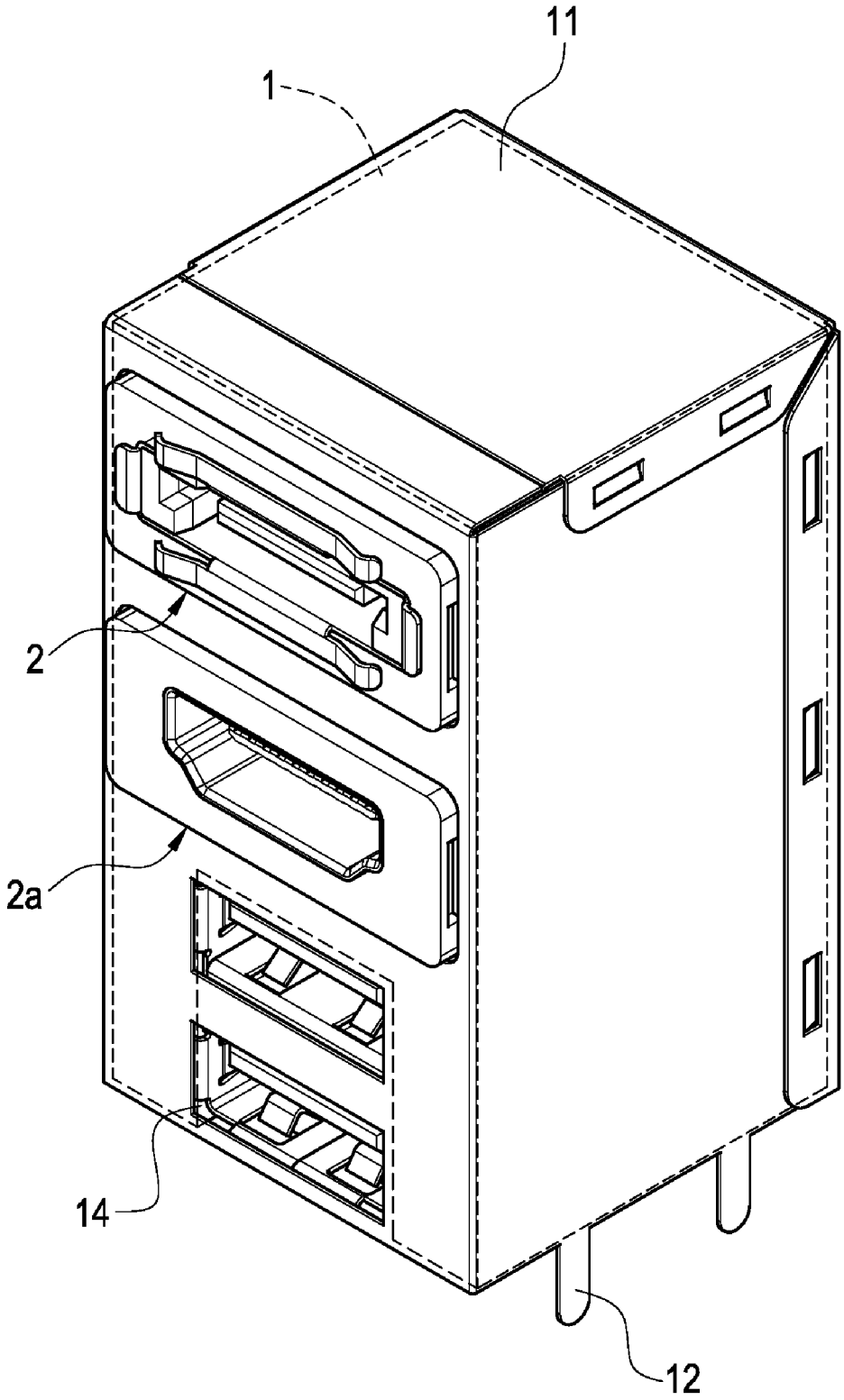
FIG. 11 is a schematic view showing a fifth embodiment of the present invention.

Please refer to FIG. 11, which shows the fifth embodiment of the present invention. As shown in this figure, two adaptor 2 and 2*a* are provided, in which two connecting ports thereof have the standards of any two of HDMI, DisplayPort, USB, and e-SATA. After the two adaptors 2 and 2*a* are assembled into the base 1, the adaptors 2 and 2*a* allows two transmission lines having different transmission interfaces selected from any two of HDMI, DisplayPort, USB and e-SATA to be inserted therein respectively for signal transmission.

Figure 12:
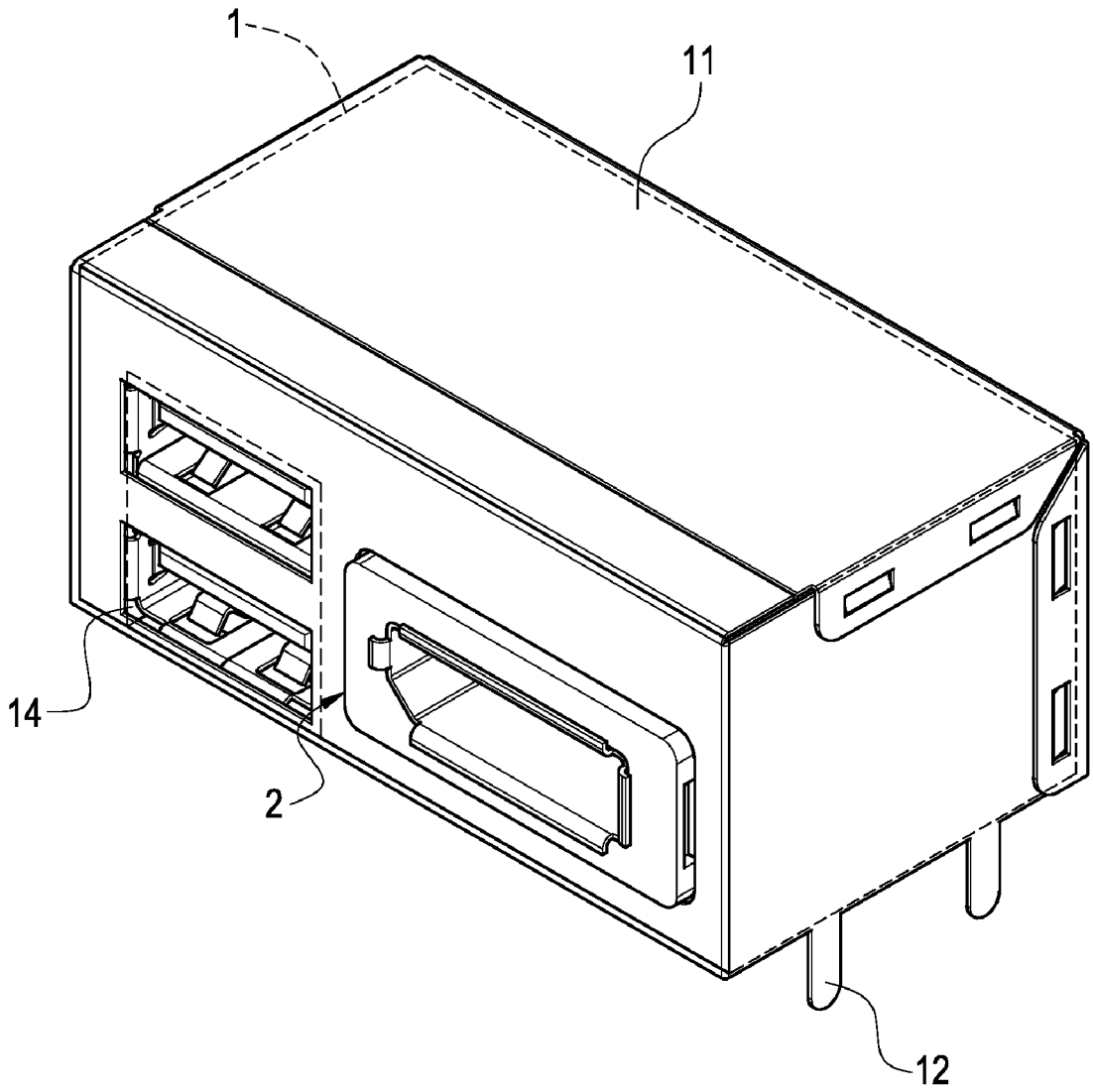
FIG. 12 is a schematic view showing a sixth embodiment of the present invention.

Please refer to FIG. 12, which shows the sixth embodiment of the present invention. As shown in this figure, in addition to a stack-up configuration, the adaptor 2 and the second assembling port 14 can be juxtaposed in the electrical connector.

Although the present invention has been described with reference to the foregoing preferred embodiments, it will be understood that the invention is not limited to the details thereof Various equivalent variations and modifications can still occur to those skilled in this art in view of the teachings of the present invention. Thus, all such variations and equivalent modifications are also embraced within the scope of the invention as defined in the appended claims.

What is claimed is:

1. A modular electrical connector, configured to be electrically connected to a plug of a flat cable comprising:

a base provided with at least one first assembling port and an insertion port, an insertion element being provided between the first assembling port and the insertion port, the insertion element having a plurality of insertion holes, each of the plurality of insertion holes being provided with an electrical-conductive pin extending into the insertion port, the insertion port allowing the plug of the flat cable to be inserted therein and electrically connected to the electrical-conductive pins; and at least one adaptor, the adaptor having a rear end with an insertion pin and a front end with a connecting port, the connecting port having a tongue therein, the tongue being provided with a plurality of electrical-conductive terminals, one end of each of the electrical-conductive terminals being electrically connected with the insertion pin, the adaptor being assembled in the first assembling port, the insertion pin being inserted into the plurality of the insertion holes and electrically connected to the electrical-conductive pin, wherein the front end of the adaptor is provided with a baffle through which the connecting port is exposed, and the adaptor is configured to be inserted into the first assembling port with only the baffle exposed outside the assembling port.

2. The modular electrical connector according to claim 1, wherein the connecting port of the adaptor has the standard of any one of HDMI, DisplayPort, USB and e-SATA.

3. The modular electrical connector according to claim 1, wherein the base further comprises a second assembling port for allowing a connector having the standard of any one of HDMI, DisplayPort, USB and e-SATA to be mounted therein.

* * * * *